US005181663A

United States Patent [19]

Dorscht et al.

[11] Patent Number: 5,181,663

[45] Date of Patent: Jan. 26, 1993

[54] TUB GRINDER WITH SCREEN PORTION

[76] Inventors: John P. Dorscht, P.O. Box 124, Union, Ontario, Canada, N0L 2L0; Patrick J. Hogan, 549 Ferndale Ct., London, Ontario, Canada, N6C 5C2

[21] Appl. No.: 829,317

[22] Filed: Feb. 3, 1992

[51] Int. Cl.[5] ..... B02C 13/286

[52] U.S. Cl. ..... 241/81; 241/101.7; 241/186.4; 241/189.1

[58] Field of Search ..... 241/81, 101.7, 186.2, 241/186.4, 189.1, 79.3

[56] References Cited

U.S. PATENT DOCUMENTS

| | | | |
|---|---|---|---|
| 209,838 | 11/1878 | Salmon et al. | 241/79.3 |
| 1,156,394 | 10/1915 | Crowe | 241/79.3 |
| 4,852,815 | 8/1989 | Gianotti | 241/65 |
| 4,934,615 | 6/1990 | Osborne | 241/101 A |
| 4,997,135 | 3/1991 | Zehr | 241/101.7 |

*Primary Examiner*—Mark Rosenbaum
*Assistant Examiner*—John M. Husar
*Attorney, Agent, or Firm*—R. Craig Armstrong

[57] ABSTRACT

A tub grinder is disclosed in which material which is already sufficiently small in size, primarily being abrasive aggregate or earthen material, may be discharged from the receptacle to bypass the comminution apparatus and thus substantially reduce wear thereto. A portion of the cylindrical wall of the receptacle is provided with classifying openings, for example by providing a screened opening as a band around the receptacle. The classifying openings permit material which is already smaller than the size of the openings to fall therethrough, thereby bypassing the comminution apparatus. Preferably, a conveyor is positioned beneath the receptacle, to catch and discharge the material which falls through the screen or other classifying openings to a pile located away from the receptacle. Sidewalls positioned on either side of the receptacle stop any material which is flung out to the side, and redirect it down onto the conveyer. The apparatus may be advantageously mounted on a trailer, for towing from site to site. In such an arrangement, it is advantageous to provide an integrated, transportable system, in which the receptacle is moveable between an operating position and a transportation position.

18 Claims, 7 Drawing Sheets

TUB GRINDER WITH SCREEN PORTION

BACKGROUND OF THE INVENTION

1. Field of the Invention

This invention relates to comminution apparatus, and in particular to tub grinders of the type having a receptacle defined by a stationary angled floor and a rotating cylindrical wall. The wall is positioned adjacent to the floor with its axis at right angle to the floor and at a substantial angle away from the vertical. An aperture in the floor leads to a hammer mill or other comminution means.

2. Description of the Prior Art

Tub grinders are well known, and are commonly used in applications such as comminuting yard waste, branches, shrubs, stumps, logs, forage crops, wooden pallets, railroad ties, slabwood, paper, cardboard, and many other materials. In such grinders, a hammer mill or other comminution means is located beneath a receptacle, with the hammers rotating about a horizontal axis with the hammers projecting up slightly into the receptacle, through an aperture provided in the stationary bottom of the receptacle. Rotating the wall of the receptacle feeds the material past the area of the hammers. The hammers pull the material through a cylindrical housing, pulverizing it and then shooting it out an exhaust, usually via a simple discharge chute.

The receptacles may be mounted with their main axis vertically oriented, in which case they are commonly referred to as tub grinders, or with the main axis at a substantial angle away from the vertical, in which case they may be referred to as tumble grinders.

Although hammer mills are commonly used in such grinders, other comminution apparatus is also common, such as flails or grinding rollers.

In any tub or tumble grinder, much of the debris being dumped into the receptacle for processing may already be sufficiently small to not require further comminution. In the case of yard waste, for example, the debris may include a large volume of abrasive aggregate including earth, sand, small stones and other abrasive materials which significantly reduce the life of the hammers or other wearing components of the comminution apparatus.

Also, it is frequently desirable to regrind material which has already been through the tumble grinder once. Naturally, a substantial portion of such reprocessed material has already been reduced to a desirable size. However, once debris is dumped into the receptacle, all of it must exit through the hammer mill or other comminution apparatus.

Thus, in a conventional grinder, it is common to process much more material through the hammer mill or other comminution apparatus than may really be necessary. This is certainly not a desirable characteristic, since it reduces the rate at which material may be processed, and places unnecessary wear on the hammers or other comminution means.

SUMMARY OF THE INVENTION

It is an object of the invention to provide an improved tub grinder, in which material which is already sufficiently small in size may be discharged from the receptacle without passing through the hammer mill or other comminution means, thereby significantly reducing wear to the comminution means, especially since much of such small material is quite abrasive.

In the invention, the receptacle is mounted at a substantial angle, e.g. typically in the range of 30 to 60 degrees from the vertical. A portion of the cylindrical wall of the receptacle is provided with classification openings, for example by providing a screen opening as a band around the receptacle. The classifying openings permit material which is already smaller than the size of the openings to fall therethrough, thereby bypassing the comminution apparatus and significantly reducing wear on the comminution apparatus.

In the preferred embodiment, the material which falls through the screen or other classifying openings falls onto a conveyor. Sidewalls are positioned on either side of the receptacle, to stop any material which flies out to one side or the other, to redirect it downwardly onto the conveyor.

The apparatus may be advantageously mounted on a trailer, for towing from site to site. In such an arrangement, it is advantageous to provide an integrated, transportable system, in which the receptacle is moveable between an operating position and a transportation position.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to &.he accompanying drawings, in which.

DETAILED DESCRIPTION OF THE PREFERRED EMBODIMENT

Figure 3:
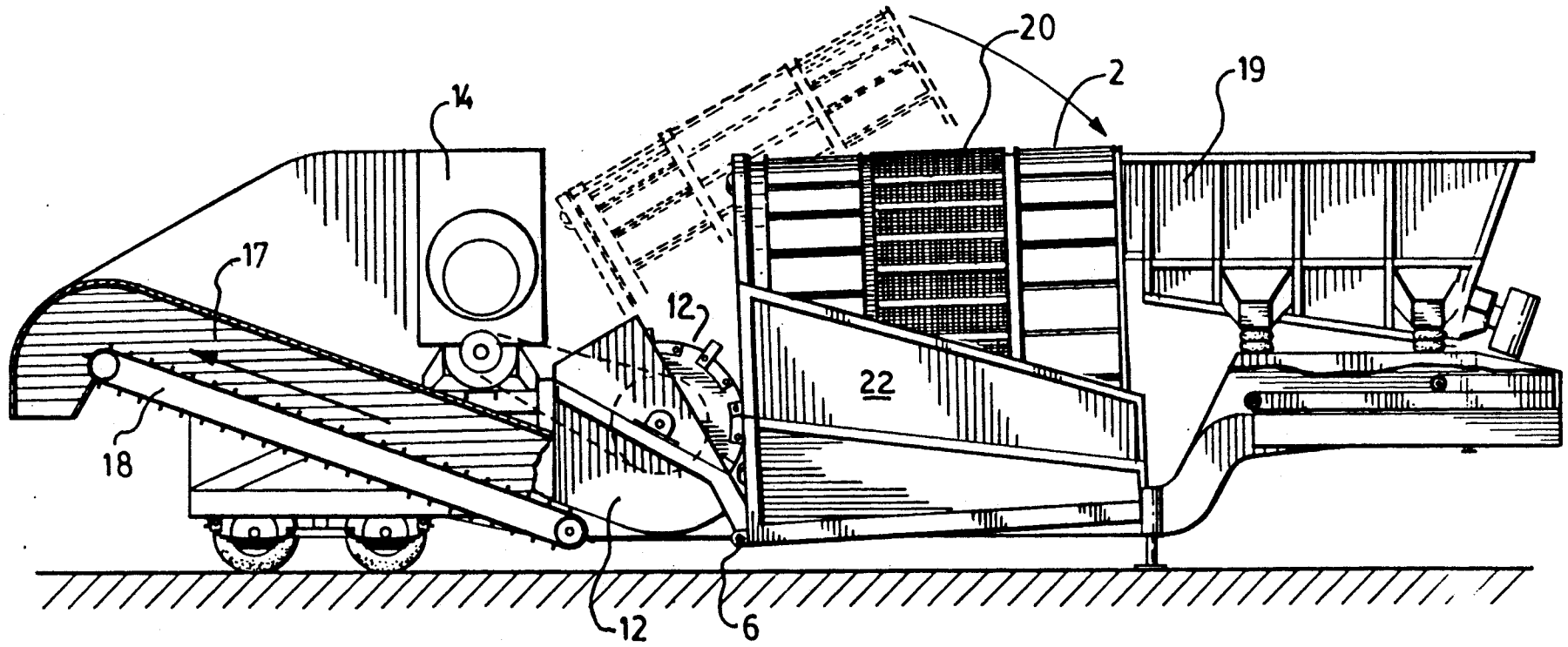
FIG. 3 is a side elevation view of the apparatus, shown in the transportation position, with the operating position shown in ghosted lines.

As illustrated in the accompanying drawings, the apparatus includes a receptacle 1 defined by a cylindrical wall 2 positioned with its axis at a right angle to a stationary angled floor 3 mounted across a portion of a support assembly 4. The support assembly is mounted on a trailer 5, and is pivotable about pivot pins 6 between an operating position and a transportation position, as seen best in FIG. 3.

Figure 5:
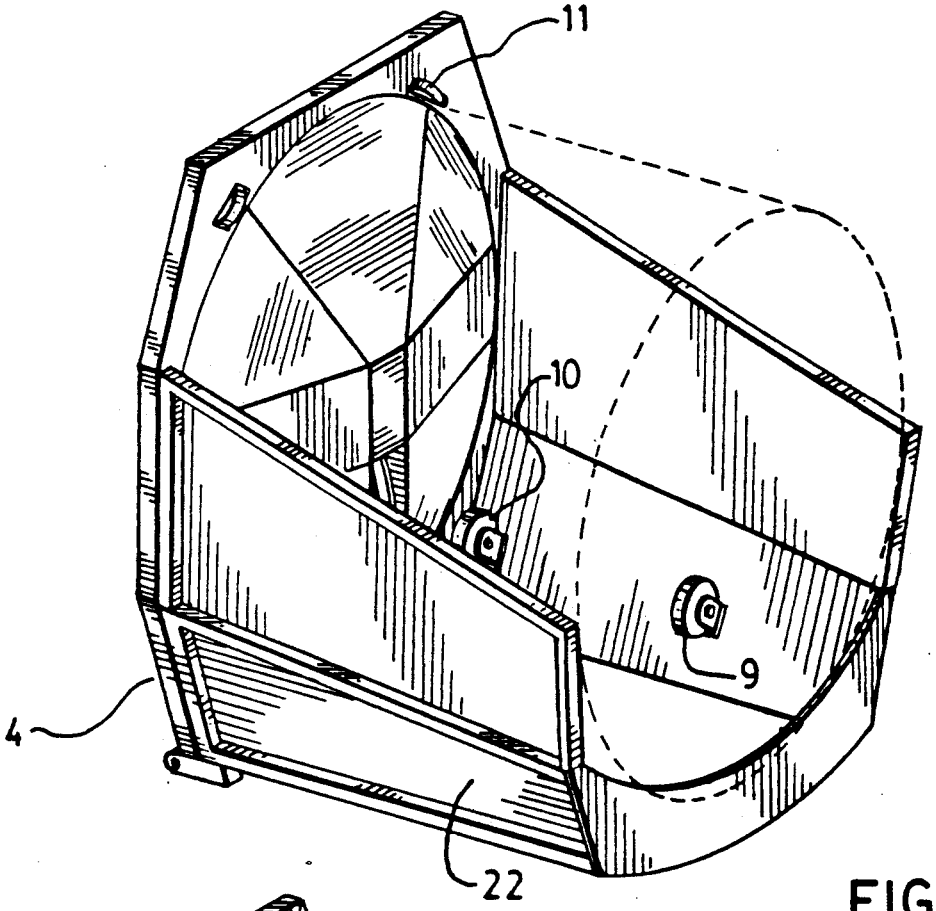
FIG. 5 is a perspective view of the receptacle support and sidewalls.

As seen best in FIG. 5, the support assembly 4 consists of a receptacle support frame 7 welded to the floor support frame 8. Receptacle support rollers are mounted on the support assembly, including upper and lower side rollers 9 and 10 respectively (two of each, i.e. one on each side), and four base rollers 11.

A hammer mill 12 is positioned with its hammers 13 projecting up through the floor of the receptacle in conventional fashion. The hammer mill is powered by a diesel engine 14. The receptacle wall is rotated in conventional fashion via a hydraulic motor 15 which drives a receptacle drive chain 16. The hammer mill shoots the material out at high velocity into a discharge chute 17, which may include a conveyor 18.

An optional orienting hopper 19 may also be mounted on the trailer, which serves to feed material into the receptacle. Material is dumped into the hopper, and is vibrated or conveyed from the hopper into the receptacle.

In prior art receptacles, the wall of the receptacle is solid. In the present invention, however, as mentioned above, classifying openings are provided such that material which is already smaller than the opening size can fall through the openings to thereby bypass the comminution apparatus. In the preferred embodiment, the classifying openings are provided by a screen 20 in the form of a band around a substantial central portion of the wall 2.

Figure 1:
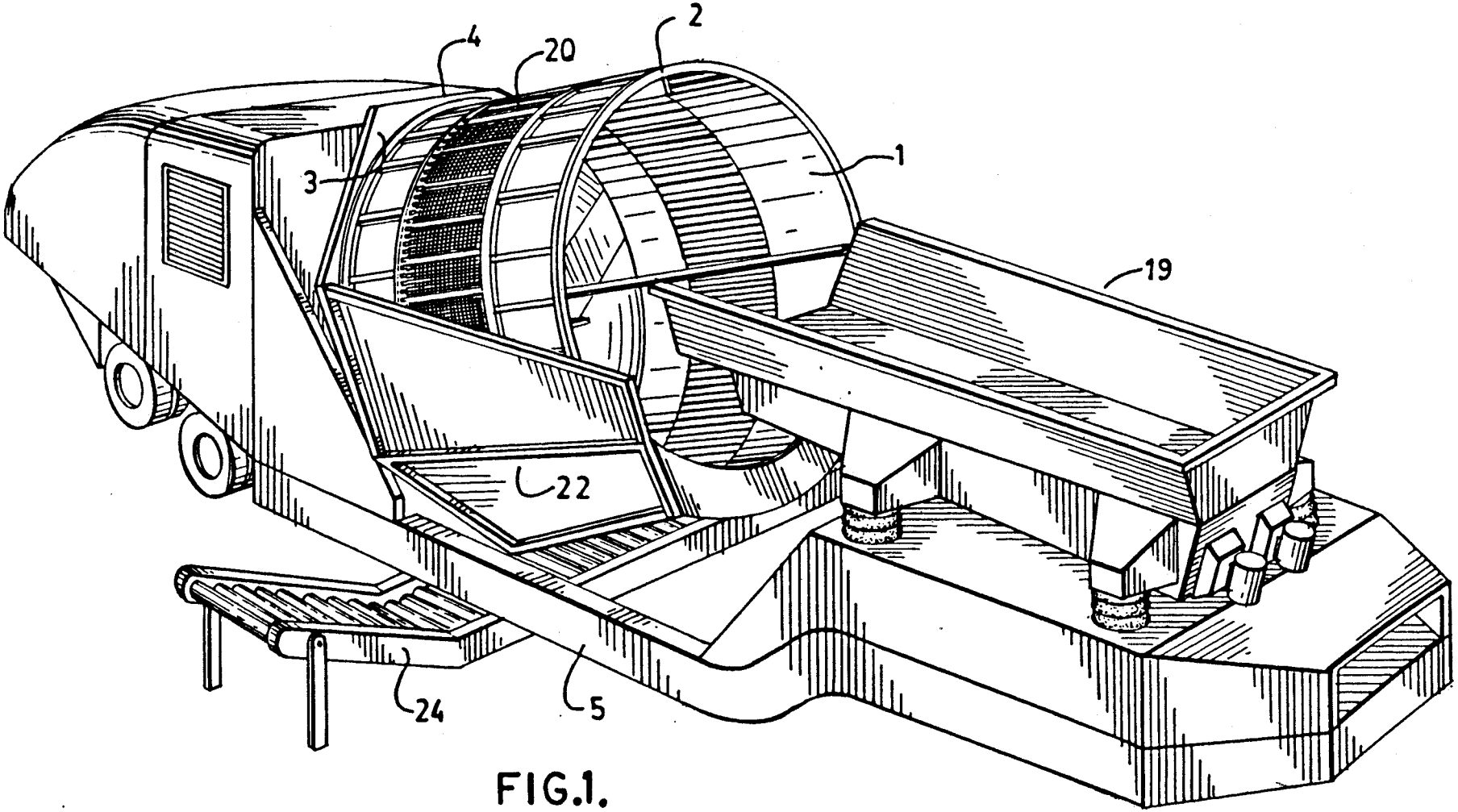
FIG. 1 is a perspective view of the apparatus mounted on a trailer.
Figure 2:
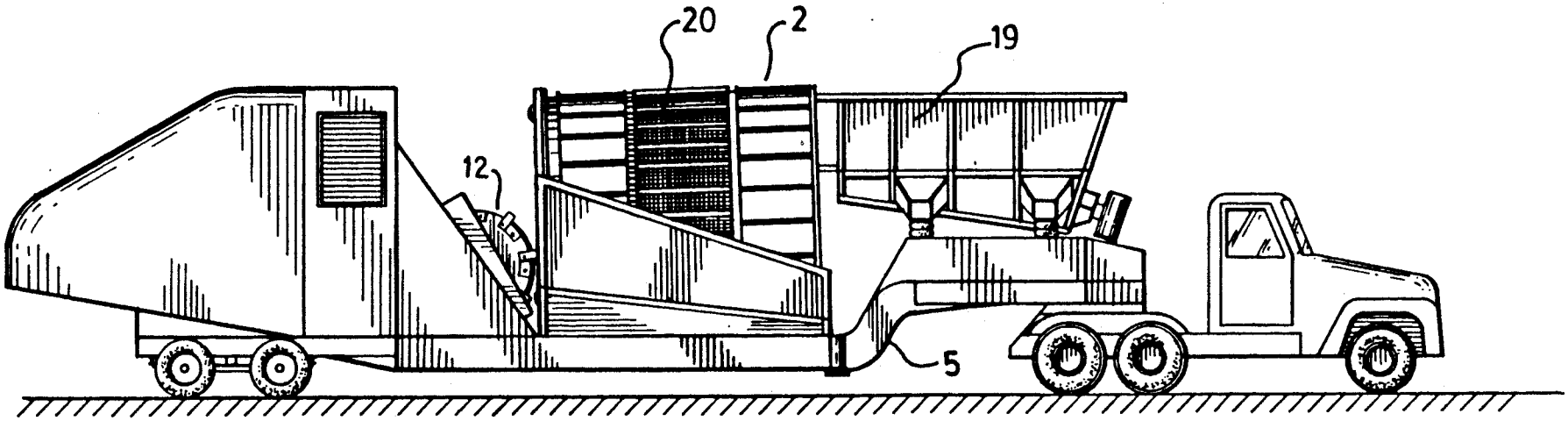
FIG. 2 is a side elevation view of the apparatus.
Figure 4:
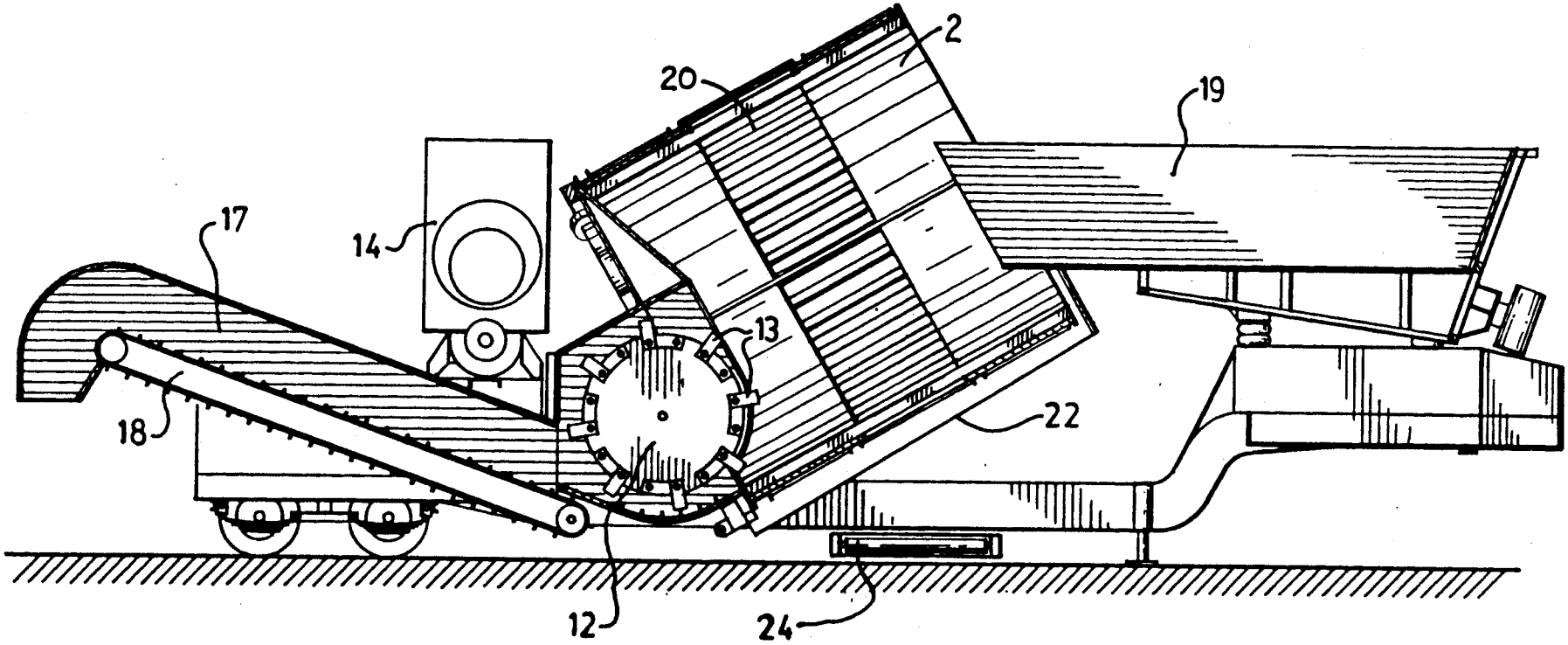
FIG. 4 is a side elevation of the apparatus, shown in section.

As seen best in FIGS. 1 and 4, material which falls through the screen falls onto a conveyor 24 which carries it out to the side of the trailer. Panels secured to the support frame 7 define sidewalls 22. The sidewalls are positioned on either side of the receptacle, to stop any material which flies out to one side or the other, to redirect it downwardly onto the conveyor.

Figure 6:
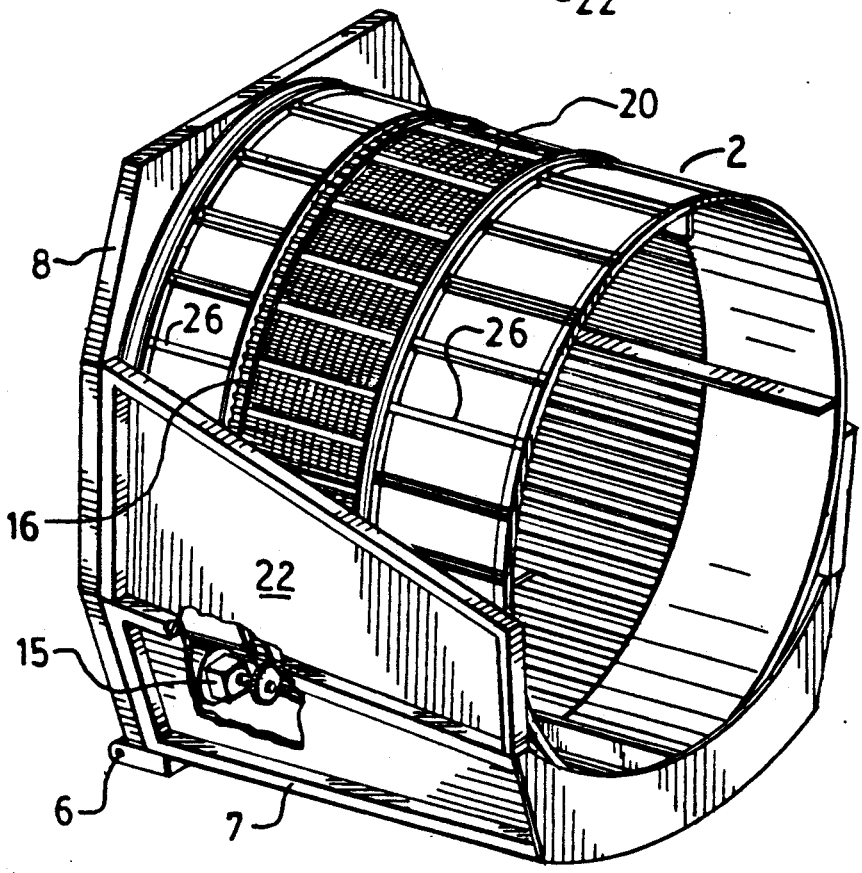
FIG. 6 is a perspective view of the receptacle, the receptacle support, and the sidewalls.
Figure 7:
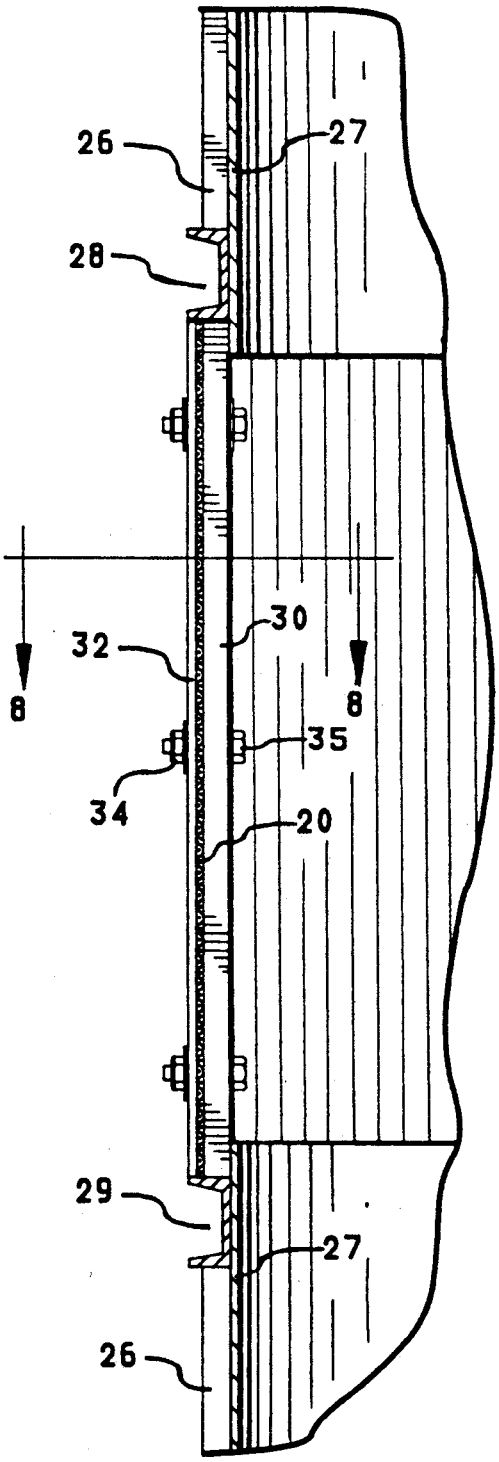
FIG. 7 is a cross-section of the receptacle wall.
Figure 8:
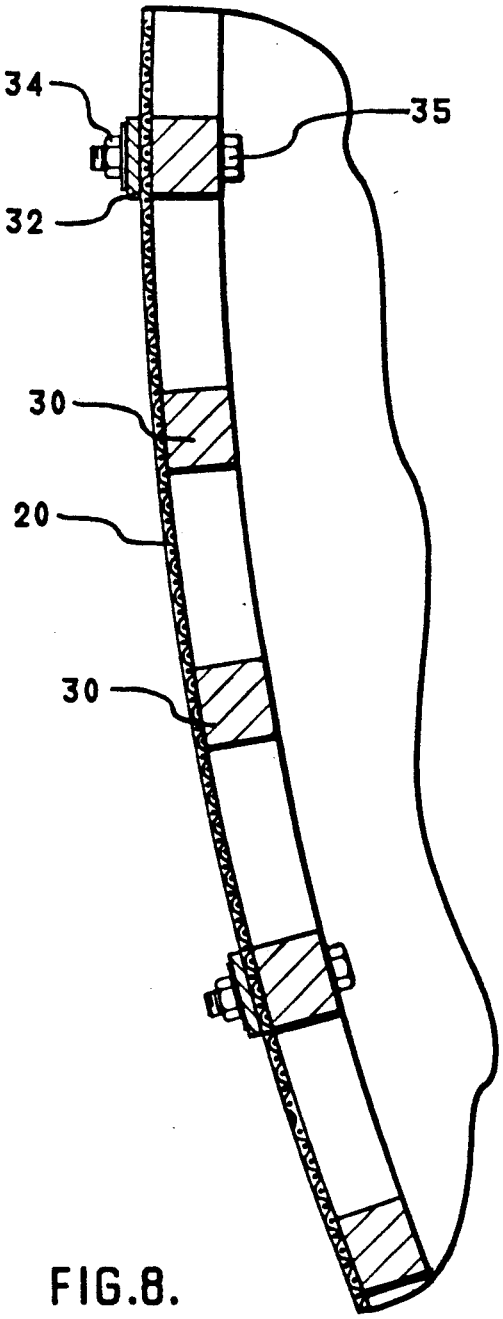
FIG. 8 is a cross-section of the receptacle wall at right angles to the cross-section of FIG. 7.
Figure 9:
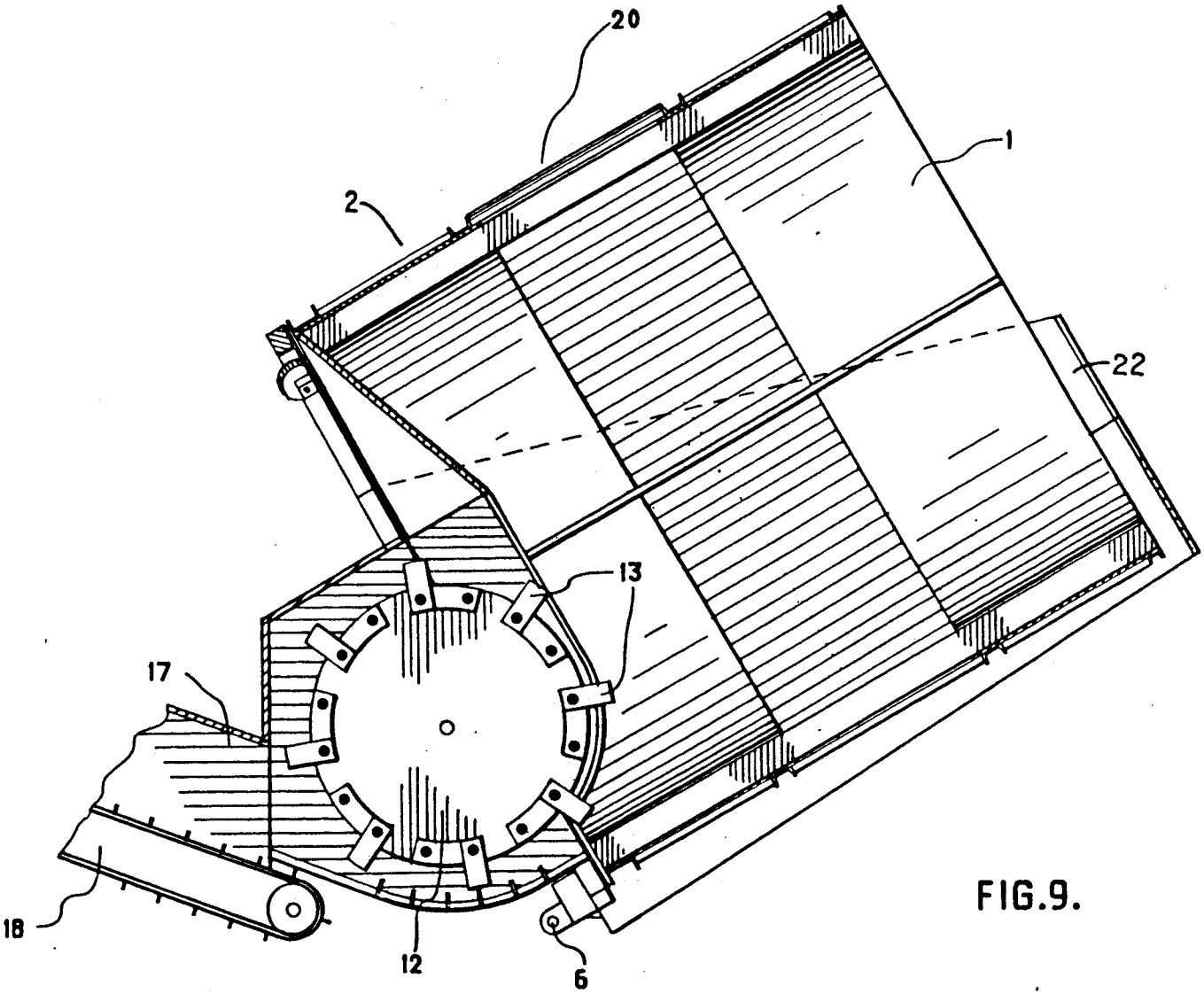
FIG. 9 is a cross-sectional elevation view of the receptacle.

Referring to FIGS. 5–7, the structure of the wall of the receptacle will now be described in detail. The upper and lower portions of the wall of the receptacle are defined by a number of longitudinal ribs 26, having a skin 27 fastened to the inside thereof to define the wall. The ribs terminate at upper and lower channel members 28 and 29 respectively on either side of the screened band 20. The upper channel member 28 receives one of the receptacle support rollers 9, while the lower channel member 29 is the site of sprocket teeth (not visible in the drawings) which are conventionally driven by the chain 16 to rotate the receptacle.

Between the channel members 28 and 29, ninety bars 30 are welded (i.e. each 4 degrees apart). The screen material 20 is overlaid on the outside of the bars. Clamping plates 32 secure the screen against the bars at every third bar, being secured by nuts 34 and bolts 35. The bars 30 prevent large, heavy material (tree stumps, for example) from damaging the screen, while allowing small material to freely pass through.

The screen 20 preferably has an opening size of about one inch, but the opening size could be varied as desired for the particular application. If desired, the screen can be changed simply by removing the clamping plates 32.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, instead of using a screen, holes could be provided in the normally solid wall of the receptacle, although the thickness of the wall might have to be increased to provide sufficient strength.

As another example, the receptacle could have an open area as in the preferred embodiment described above, with wires routed around the receptacle across the opening, instead of a screen. It would be feasible to use almost any conventional classifying means which permits material of less than a certain size to pass through while blocking large material.

What is claimed as the invention is:

1. Tub grinding apparatus, comprising:

a floor angled away from the horizontal, having an opening therethrough communicating with comminution means attached thereto, and a cylindrical wall positioned against and generally above said floor with its axis at a right angle thereto to define an angled receptacle for receiving material to be comminuted by said comminution means, said wall being rotatable with respect to said floor about said axis; and means for rotating said cylindrical wall to cause tumbling of said material to be comminuted; where said cylindrical wall has classifying openings therethrough around a substantial portion thereof, whereby material small enough to pass through said classifying openings may fall from said receptacle through said wall instead of being routed to said comminution means.

2. Apparatus as recited in claim 1, where said classifying openings are provided by virtue of a substantially open band around said wall, said substantially open band having a screen mounted therearound, covering said substantially open area.

3. Apparatus as recited in claim 2, mounted on a trailer, where said receptacle is pivotally mounted on said trailer for movement between an angled operating position and a generally horizontal transportation position.

4. Apparatus as recited in claim 2, where said substantially open band is formed by virtue of upper and lower circumferential channel members on either side of said band, a plurality of spaced-apart bars secured between said channel members, screen material overlaid on the outside of said bars, and clamping plates outside said screen material fastened to at least some of said bars to secure said screen material against said bars.

5. Apparatus as recited in claim 4, mounted on a trailer, where said receptacle is pivotally mounted on said trailer for movement between an angled operating position and a generally horizontal transportation position.

6. Apparatus as recited in claim 1, further comprising means positioned beneath said classifying opening portion for catching said material which falls through said classifying openings and for conveying said material away from beneath said classifying openings.

7. Apparatus as recited in claim 6, mounted on a trailer, where said receptacle is pivotally mounted on said trailer for movement between an angled operating position and a generally horizontal transportation position.

8. Apparatus as recited in claim 6, further comprising stationary sidewalls positioned on either side of said receptacle opposite said classifying openings, whereby material which is flung out to one side or the other through said classifying openings is stopped and redirected to drop down onto said means for catching and conveying said material from beneath said classifying openings.

9. Apparatus as recited in claim 8, mounted on a trailer, where said receptacle is pivotally mounted on said trailer for movement between an angled operating position and a generally horizontal transportation position.

10. Apparatus as recited in claim 8, where said classifying openings are provided by virtue of a substantially open band around said wall, said substantially open band having a screen mounted therearound, covering said substantially open area.

11. Apparatus as recited in claim 10, mounted on a trailer, where said receptacle is pivotally mounted on said trailer for movement between an angled operating position and a generally horizontal transportation position.

12. Apparatus as recited in claim 10, where said substantially open band is formed by virtue of upper and lower circumferential channel members on either side of said band, a plurality of spaced-apart bars secured between said channel members, screen material overlaid on the outside of said bars, and clamping plates outside said screen material fastened to at least some of said bars to secure said screen material against said bars.

13. Apparatus as recited in claim 12, mounted on a trailer, where said receptacle is pivotally mounted on said trailer for movement between an angled operating position and a generally horizontal transportation position.

14. Apparatus as recited in claim 6, where said classifying openings are provided by virtue of a substantially open band around said wall, said substantially open band having a screen mounted therearound, covering said substantially open area.

15. Apparatus as recited in claim 14, mounted on a trailer, where said receptacle is pivotally mounted on said trailer for movement between an angled operating position and a generally horizontal transportation position.

16. Apparatus as recited in claim 14, where said substantially open band is formed by virtue of upper and lower circumferential channel members on either side of said band, a plurality of spaced-apart bars secured between said channel members, screen material overlaid on the outside of said bars, and clamping plates outside said screen material fastened to at least some of said bars to secure said screen material against said bars.

17. Apparatus as recited in claim 16, mounted on a trailer, where said receptacle is pivotally mounted on said trailer for movement between an angled operating position and a generally horizontal transportation position.

18. Apparatus as recited in claim 1, mounted on a trailer, where said receptacle is pivotally mounted on said trailer for movement between an angled operating position and a generally horizontal transportation position.

* * * * *